US006892663B1

(12) United States Patent
Freese, Jr.

(10) Patent No.: US 6,892,663 B1
(45) Date of Patent: May 17, 2005

(54) BILGE WATER EXTRACTION DEVICE

(76) Inventor: Fredric Freese, Jr., 76 Coppermine Rd., Princeton, NJ (US) 08540

( * ) Notice: Subject to any disclaimer, the term of this patent is extended or adjusted under 35 U.S.C. 154(b) by 39 days.

(21) Appl. No.: 10/389,205

(22) Filed: Mar. 14, 2003

(51) Int. Cl.[7] ..... B63B 13/00
(52) U.S. Cl. ..... 114/183 R
(58) Field of Search ..... 114/183 R, 184, 114/185, 183 A

(56) References Cited

U.S. PATENT DOCUMENTS 3,771,920 A 11/1973 Grant
4,031,839 A 6/1977 Pedone
4,986,777 A 1/1991 Preston
6,312,596 B1 * 11/2001 Kunzelman ..... 210/242.3
2003/0211291 A1 * 11/2003 Castiglione et al. ..... 428/172

* cited by examiner

*Primary Examiner*—Ed Swinehart

(57) ABSTRACT

A bilge water extraction device for removing water from a bilge of a boat to inhibit damage to the boat from the water. The bilge water extraction device includes a body member comprising an insertion portion and an extension portion. The insertion portion is designed for being positioned in the bilge of the boat whereby the extension portion extends from a drain hole in fluid communication with the bilge. The insertion portion of the body member is designed for absorbing water whereby water absorbed by the insertion portion is transferred to the extension portion through capillary action to allow the water to evaporate.

7 Claims, 2 Drawing Sheets

BILGE WATER EXTRACTION DEVICE

BACKGROUND OF THE INVENTION

1. Field of the Invention

The present invention relates to bilge pumps and more particularly pertains to a new bilge water extraction device for removing water from a bilge of a boat to inhibit damage to the boat from the water.

2. Description of the Prior Art

The use of bilge pumps is known in the prior art. U.S. Pat. No. 3,771,920 describes a device for discharging foul gases from the bottom of a boat. Another type of bilge pump is U.S. Pat. No. 4,986,777 having a marine oil drainage device for facilitating the drainage of oil from an inboard engine. U.S. Pat. No. 4,031,839 has an oil absorbent pad positioned in the bilge of the boat to remove oil from the water collected in the bilge of the boat.

While these devices fulfill their respective, particular objectives and requirements, the need remains for a device that has certain improved features to remove water from the bilge that is not removed by the bilge pump.

SUMMARY OF THE INVENTION

The present invention meets the needs presented above by providing an insertion portion of a body member that extends into bilge with an extension portion extending out from the bilge to draw water out of the bilge so that the water can evaporate.

Still yet another object of the present invention is to provide a new bilge water extraction device that provides a material for drawing the water from the bilge with capillary action.

Even still another object of the present invention is to provide a new bilge water extraction device that can be used to detect the presence of fluids other than water in the bilge by providing the body member in a light color so the fluids stain the body member a different color and indicate a possible leak of fluids such as marine oil or transmission fluid.

To this end, the present invention generally comprises a body member comprising an insertion portion and an extension portion. The insertion portion is designed for being positioned in the bilge of the boat whereby the extension portion extends from a drain hole in fluid communication with the bilge. The insertion portion of the body member is designed for absorbing water whereby water absorbed by the insertion portion is transferred to the extension portion through capillary action to allow the water to evaporate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
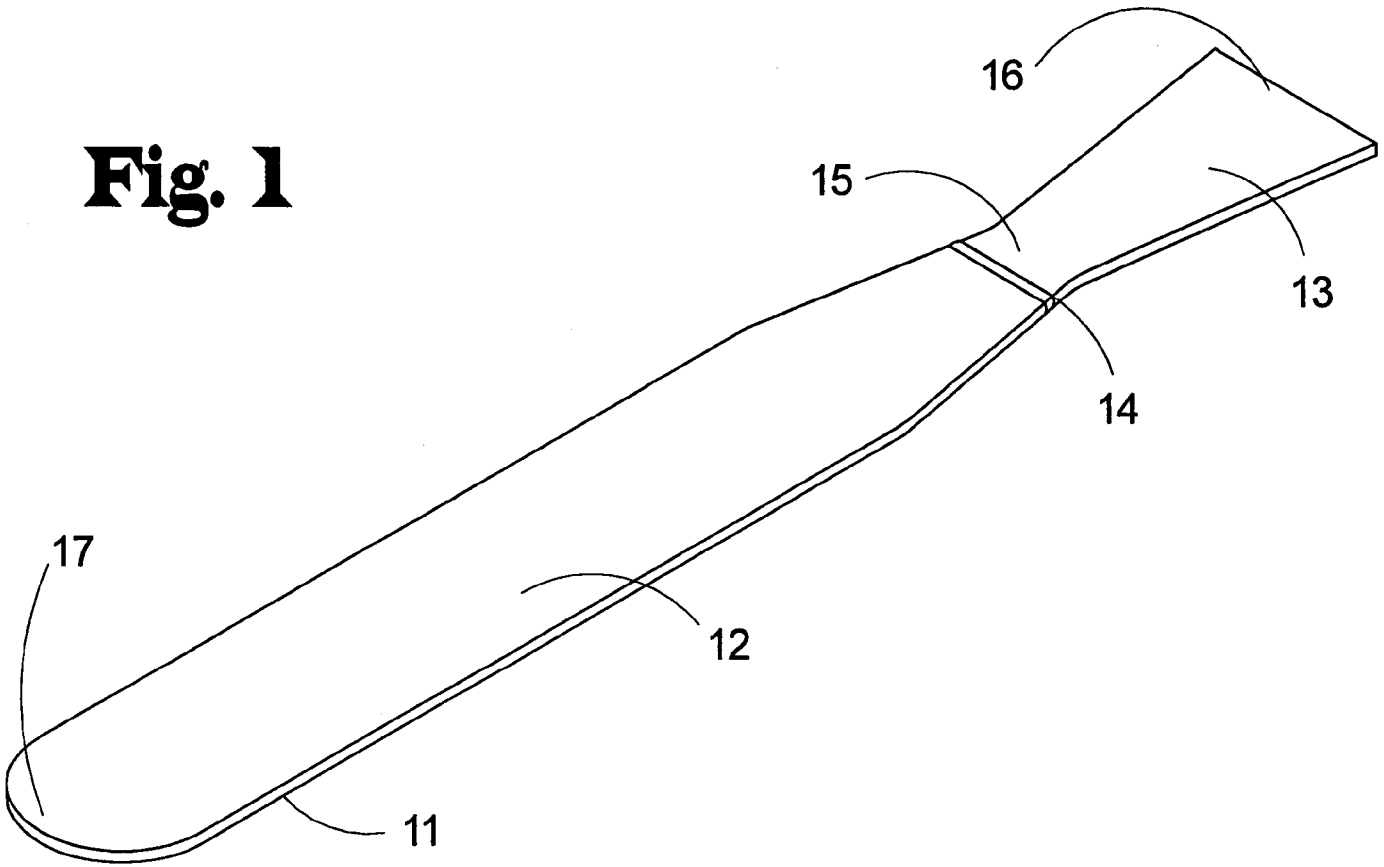
FIG. 1 is a perspective view of a new bilge water extraction device according to the present invention shown in use.
Figure 2:
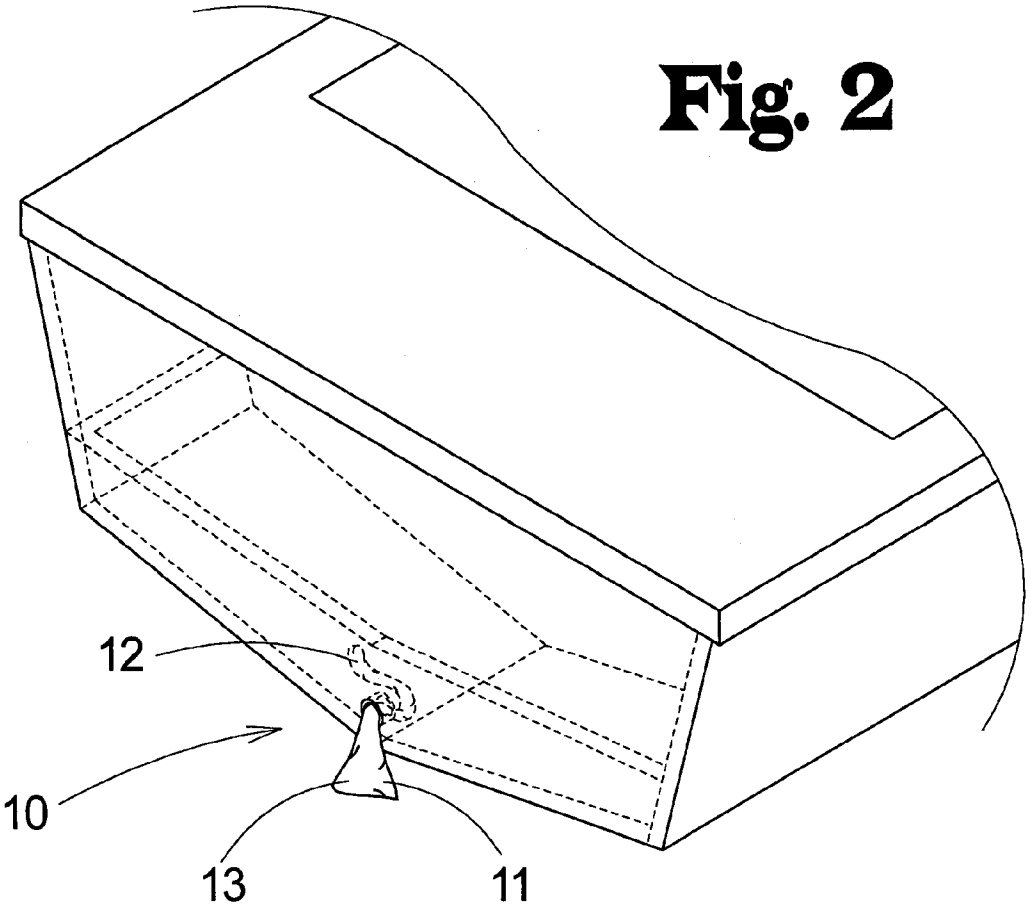
FIG. 2 is a perspective view of the present invention.

With reference now to the drawings, and in particular to FIGS. 1 and 2 thereof, a new bilge water extraction device embodying the principles and concepts of the present invention and generally designated by the reference numeral 10 will be described.

As best illustrated in FIGS. 1 and 2, the bilge water extraction device 10 generally comprises a body member 11 comprising an insertion portion 12 and an extension portion 13. The insertion portion 12 is designed for being positioned in the bilge of the boat whereby the extension portion 13 extends from a drain hole in fluid communication with the bilge. The insertion portion 12 of the body member 11 is designed for absorbing water whereby water absorbed by the insertion portion 12 is transferred to the extension portion 13 through capillary action to allow the water to evaporate when the drain hole is exposed to air such as when the boat is being transported over the land or is in dry dock.

A retention member 14 is coupled to the body member 11. The retention member 14 is coupled between the insertion portion 12 and the extension portion 13 of the body member 11. The retention member 14 is designed for being selectively inserted into the drain hole when the insertion portion 12 is inserted into the bilge whereby the retention portion is designed for extending across the drain hole to inhibit the body member 11 from inadvertently sliding out of the bilge.

The retention member 14 comprises a semi-rigid material. The semi-rigid material is designed for allowing the retention member 14 to be flexed to be inserted into the drain hole and extending across the drain hole when the retention member 14 has been inserted through the drain hole.

The extension portion 13 of the body member 11 comprises a first end 15 and a second end 16. The first end 15 is coupled to the insertion portion 12 of the body member 11. The extension portion 13 tapers outwardly from the first end 15 to the second end 16 whereby a width of the first end 15 is less than a width of the second end 16. The first end 15 is designed for being positioned in the drain hole whereby the tapering in of the extension portion 13 towards the first end 15 does not restrict the flow of water through the drain hole.

The body member 11 comprises a woven material, such as a cotton and polyester blend or terry cloth. The woven material is designed for facilitating capillary action of the water along the body member 11 by allowing the water to flow between strands of the woven material.

The insertion portion 12 of the body member 11 comprises a free end 17. The free end 17 of the insertion portion 12 is positioned opposite the extension portion 13 of the body member 11. The free end 17 of the insertion portion 12 is arcuate whereby the free end 17 is designed for facilitating insertion of the insertion portion 12 of the body member 11 through the drain hole and into the bilge.

In use, the user inserts the free end 17 of the insertion portion 12 into the drain hole and pushes the insertion portion 12 of the body member 11 into the bilge of the boat. The retention member 14 is then slipped through the drain hole and positioned in the bilge so that the retention member 14 abuts the drain hole and inhibits the body member 11 from being inadvertently removed from the bilge and drain hole. The water is then absorbed by the insertion portion 12 and through capillary action the water moves to the extension portion 13 of the body member 11 where the water evaporates. This allows the water not being removed by a bilge pump to be removed from the bilge to prevent damage to the boat and bilge pump due to rotting, mildewing and freezing.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bilge water extraction device for facilitating extraction of water from a bilge of a boat, the bilge water extraction device comprising:

a body member comprising an insertion portion and an extension portion, said insertion portion being adapted for being positioned in the bilge of the boat such that said extension portion extends from a drain hole in fluid communication with the bilge, said insertion portion of said body member being adapted for absorbing water such that water absorbed by said insertion portion is transferred to said extension portion through capillary action to allow the water to evaporate when the drain hole is exposed to air.

2. The bilge water extraction device as set forth in claim 1, further comprising:

a retention member being coupled to said body member, said retention member being coupled between said insertion portion and said extension portion of said body member, said retention member being adapted for being selectively inserted into the drain hole when said insertion portion is inserted into the bilge such that said retention portion is adapted for extending across the drain hole to inhibit said body member from inadvertently sliding out of the bilge.

3. The bilge water extraction device as set forth in claim 2, further comprising:

said retention member comprising a semi-rigid material, said semi-rigid material being adapted for allowing said retention member to be flexed to be inserted into the drain hole and extending across the drain hole when said retention member has been inserted through the drain hole.

4. The bilge water extraction device as set forth in claim 1, further comprising:

said extension portion of said body member comprising a first end and a second end, said first end being coupled to said insertion portion of said body member, said extension portion tapering outwardly from said first end to said second end such that a width of said first end is less than a width of said second end, said first end being adapted for being positioned in the drain hole such that the tapering in of said extension portion towards said first end does not restrict the flow of water through the drain hole.

5. The bilge water extraction device as set forth in claim 1, further comprising:

said body member comprising a woven material, said woven material being adapted for facilitating capillary action of the water along said body member by allowing the water to flow between strands of said woven material.

6. The bilge water extraction device as set forth in claim 1, further comprising:

said insertion portion of said body member comprises a free end, said free end of said insertion portion being positioned opposite said extension portion of said body member, said free end of said insertion portion being arcuate such that said free end is adapted for facilitating insertion of said insertion portion of said body member through the drain hole and into the bilge.

7. A bilge water extraction device for facilitating extraction of water from a bilge of a boat, the bilge water extraction device comprising:

a body member comprising an insertion portion and an extension portion, said insertion portion being adapted for being positioned in the bilge of the boat such that said extension portion extends from a drain hole in fluid communication with the bilge, said insertion portion of said body member being adapted for absorbing water such that water absorbed by said insertion portion is transferred to said extension portion through capillary action to allow the water to evaporate when the drain hole is exposed to air;

a retention member being coupled to said body member, said retention member being coupled between said insertion portion and said extension portion of said body member, said retention member being adapted for being selectively inserted into the drain hole when said insertion portion is inserted into the bilge such that said retention portion is adapted for extending across the drain hole to inhibit said body member from inadvertently sliding out of the bilge;

said retention member comprising a semi-rigid material, said semi-rigid material being adapted for allowing said retention member to be flexed to be inserted into the drain hole and extending across the drain hole when said retention member has been inserted through the drain hole;

said extension portion of said body member comprising a first end and a second end, said first end being coupled to said insertion portion of said body member, said extension portion tapering outwardly from said first end to said second end such that a width of said first end is less than a width of said second end, said first end being adapted for being positioned in the drain hole such that the tapering in of said extension portion towards said first end does not restrict the flow of water through the drain hole;

said body member comprising a woven material, said woven material being adapted for facilitating capillary action of the water along said body member by allowing the water to flow between strands of said woven material; and said insertion portion of said body member comprises a free end, said free end of said insertion portion being positioned opposite said extension portion of said body member, said free end of said insertion portion being arcuate such that said free end is adapted for facilitating insertion of said insertion portion of said body member through the drain hole and into the bilge.

* * * * *